US007891668B2

(12) United States Patent
Box

(10) Patent No.: US 7,891,668 B2
(45) Date of Patent: Feb. 22, 2011

(54) ARCHERY TARGET AND METHOD OF MAKING THE SAME

(76) Inventor: Joe G. Box, 10380 N. Pond La., Twinsburg, OH (US) 44087

( * ) Notice: Subject to any disclaimer, the term of this patent is extended or adjusted under 35 U.S.C. 154(b) by 0 days.

(21) Appl. No.: 12/272,862

(22) Filed: Nov. 18, 2008

(65) Prior Publication Data

US 2009/0134581 A1 May 28, 2009

Related U.S. Application Data

(60) Provisional application No. 61/066,764, filed on Feb. 22, 2008, provisional application No. 61/004,352, filed on Nov. 27, 2007.

(51) Int. Cl.
*F41J 3/00* (2006.01)

(52) U.S. Cl. ..... 273/408; 273/407

(58) Field of Classification Search ..... 273/403–410, 273/371–377; 428/66.6
See application file for complete search history.

(56) References Cited

U.S. PATENT DOCUMENTS

| | | | | | |
|---|---|---|---|---|---|
| 1,837,627 | A | | 12/1931 | Mead et al. | |
| 2,305,271 | A | * | 12/1942 | Pearson | 273/408 |
| 2,818,258 | A | | 12/1957 | Stern | |
| 2,990,179 | A | | 6/1961 | Barna | |
| 3,048,401 | A | | 8/1962 | Dishon | |
| 3,109,618 | A | * | 11/1963 | Saunders | 248/464 |
| 3,164,384 | A | | 1/1965 | Stewart | |
| 3,329,431 | A | * | 7/1967 | Roesner | 273/403 |
| 3,396,971 | A | | 8/1968 | Estep | |
| 3,900,778 | A | | 8/1975 | Bruner | |
| 4,076,246 | A | | 2/1978 | Meyer | |
| 4,126,501 | A | | 11/1978 | Croll | |
| 4,244,585 | A | * | 1/1981 | Croll | 273/408 |
| 4,491,328 | A | * | 1/1985 | Meyer | 273/403 |
| 5,290,042 | A | | 3/1994 | Worley et al. | |
| 5,503,403 | A | * | 4/1996 | Morrell | 273/403 |
| 5,618,603 | A | * | 4/1997 | DeRees | 428/66.6 |
| 5,865,440 | A | | 2/1999 | Pulkrabek | |
| 6,045,132 | A | * | 4/2000 | Giegerich | 273/408 |
| 6,068,261 | A | * | 5/2000 | Nettle | 273/408 |
| 6,254,100 | B1 | * | 7/2001 | Rinehart | 273/403 |
| 6,926,281 | B1 | | 8/2005 | Woock | |

(Continued)

FOREIGN PATENT DOCUMENTS

| | | |
|---|---|---|
| GB | 2 365 366 | 2/2002 |

*Primary Examiner*—Mark S Graham
(74) *Attorney, Agent, or Firm*—Rankin, Hill & Clark LLP

(57) ABSTRACT

An archery target configured to absorb an impact of an associated arrow. The target having a stand having a top side and a bottom side and the bottom side including a support structure for supporting the archery target on an associated surface. The top side including a target rest shaped to receive a portion of an outer perimeter of a cylindrical target portion in shaped engagement. The target portion having a front side and a back side which extend between the outer perimeter and define a target depth and including a central core extending between front and back sides of the target. The core defining a target axis coaxial with the outer perimeter and the target portion further including at least one general planar sheet having side edges defining a sheet width that is generally equal to the target depth and a sheet surface between the side edges.

25 Claims, 9 Drawing Sheets

U.S. PATENT DOCUMENTS

| | | | | |
|---|---|---|---|---|
| 7,222,860 | B2 | 5/2007 | Box et al. | |
| 7,549,433 | B2 * | 6/2009 | Zheng | 135/126 |
| 2003/0146575 | A1 * | 8/2003 | Giegerich et al. | 273/407 |
| 2007/0013138 | A1 * | 1/2007 | Hinnant | 273/407 |
| 2007/0029733 | A1 * | 2/2007 | Anderson, Jr. | 273/408 |

* cited by examiner

ARCHERY TARGET AND METHOD OF MAKING THE SAME

This application claims priority in provisional patent application Ser. No. 61/066,764 filed on Feb. 22, 2008 and provisional patent application Ser. No. 61/004,352 filed on Nov. 27, 2007 both of which are incorporated by reference herein.

The invention of this application relates to targets and, more particularly, to a rolled archery target.

INCORPORATION BY REFERENCE

U.S. Pat. No. 3,164,384 discloses an archery target and is incorporated by reference herein for showing the same. U.S. Pat. No. 3,900,778 discloses an archery target configured from a corrugated material and is incorporated by reference herein for showing same. U.S. Pat. No. 1,837,627 discloses an archery target and is incorporated by reference herein for showing the same. U.S. Pat. No. 3,048,401 discloses an archery target and is incorporated by reference herein for showing the same. U.S. Pat. No. 3,396,971 discloses an archery target and is incorporated by reference herein for showing the same. U.S. Pat. No. 2,990,179 discloses an archery target and is incorporated by reference herein for showing the same. U.S. Pat. No. 4,076,246 discloses an archery target and is incorporated by reference herein for showing the same. U.S. Pat. No. 4,244,585 discloses an archery target and is incorporated by reference herein for showing the same. U.S. Pat. No. 5,865,440 discloses an archery target and is incorporated by reference herein for showing the same. U.S. Pat. No. 6,926,281 discloses an archery target and is incorporated by reference herein for showing the same. U.K. Patent GB 2 365 366 discloses an archery target and is incorporated by reference herein for showing the same. U.S. Pat. No. 2,818,258 discloses an archery target and is incorporated by reference herein for showing the same. U.S. Pat. No. 5,290,042 discloses an archery target and is incorporated by reference herein for showing the same. U.S. Pat. No. 7,222,860 discloses an archery target and is incorporated by reference herein for showing the same. U.S. Pat. No. 4,126,501 discloses an archery target and is incorporated by reference herein for showing the same.

BACKGROUND OF THE INVENTION

Archery targets have been around for many years and have had many configurations over these years. These include disc shaped targets, cylindrical targets, rectangular targets and even cube-shaped targets. Further, these targets have been formed by a wide range of material from hay to high technology composites. However, these prior art targets have had several deficiencies including high manufacturing costs and/or low life expectancy.

In this respect, many prior art archery targets, such as those formed by hay, produce an effective target but, quickly breakdown wherein replacement is necessarily early in the life of the target. Over the years, there have been improvements to the traditional hay targets which utilize materials such as corrugated materials to increase the life expectancy of the target. While vast improvements have been made, these changes to the target configuration have adversely impacted the costs of the target product by necessitating complicated manufacturing techniques and/or expensive materials.

For example, prior art targets include targets formed by closed cell foam sheet materials that are compressed and maintained between opposing rigid members by compression straps. While this target configuration is structurally solid and has been well received in the marketplace, production of the compressed sheet target is labor intensive and requires large scale equipment for the sizing of the foam sheet and for the compression of the foam sheets. Accordingly, while these compression sheet targets work well as an archery target, they can be costly and manufacturing high volumes of the targets can be difficult.

SUMMARY OF THE INVENTION

The invention of this application relates to an archery target. More particularly, the archery target according to the present invention includes a base member having an upwardly open support surface shaped to receive a cylindrical target portion formed by a foam sheet material wrapped about a horizontal axis.

In accordance with another aspect of the present invention, an archery target configured to absorb an impact of an associated arrow is provided which includes a stand having a top side and a bottom side and the bottom side including a support structure for supporting the archery target on an associated surface. The top side including a target rest shaped to receive a portion of an outer perimeter of a cylindrical target portion in shaped engagement. The target portion having a front side and a back side which extend between the outer perimeter and define a target depth and including a central core extending between front and back sides of the target. The core defining a target axis coaxial with the outer perimeter and the target portion further including at least one general planar sheet having side edges defining a sheet width that is generally equal to the target depth and a sheet surface between the side edges. The at least one sheet being wrapped about the core and the target axis and the side edges at least partially forming the arrow receiving zone wherein a portion of the sheet surface forming the outer perimeter.

According to another aspect of the present invention, the target portion has an elongated central core wherein the core is formed by a pliable material having a square cross-sectional configuration with a length and a width wherein the width is between 0.25 and 2.5 inches and the length extends in an axial direction and defines a central target axis. The square cross-sectional configuration of the core forming four general flat sides and the target further includes a planar sheet of pliable material extending between an inner end and an outer end and the sheet having side edges and a sheet surface that extend between the inner and outer ends. The inner end of the sheet being affixed to one of the four generally flat sides of the core such that the inner end is fixed relative to the core. The planar sheet extending about the core in tightly wrapped convolutions wherein the outer end and a portion of the sheet surface form an outer perimeter of the archery target and the core is substantially formed into a cylindrical core. The side edges of the sheet forming a front and back surface of the target which include at least one shooting surface and the target including at least one strap extending about at least a portion of the outer perimeter to maintain the tightly wrapped convolutions.

BRIEF DESCRIPTION OF THE DRAWINGS

The foregoing, and more, will in part be obvious in conjunction with a written description of the invention illustrated in the accompanying drawings in which.

DESCRIPTION OF PREFERRED EMBODIMENTS

Figure 1:
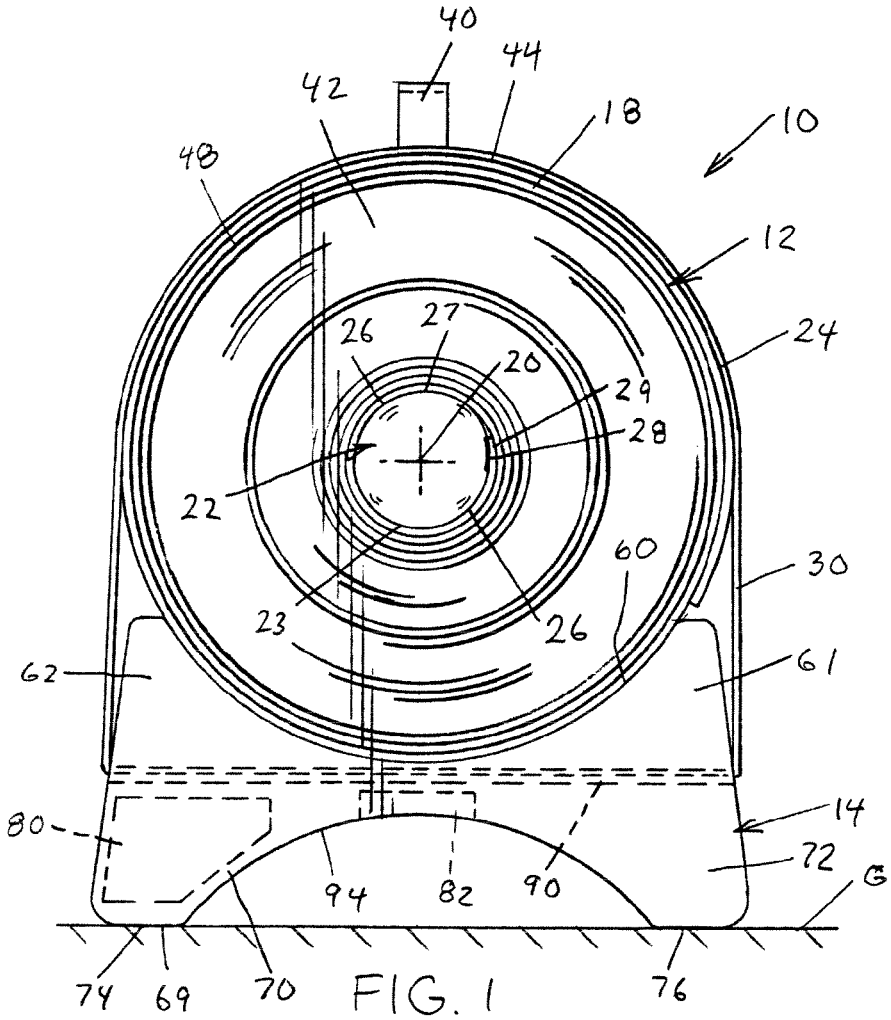
FIG. 1 is a front view of a target according to the invention of this application.

Referring now greater detail to the drawings wherein the showings are for the purpose of illustrating preferred embodiments of the invention only, and not for the purpose of limiting the invention, shown in FIGS. 1-4 is an archery target 10 formed by a target portion 12 and a stand 14.

In one embodiment, target portion 12 is a wrapped target formed by the wrapping at least one general planar sheet of material 18 about a central axis 20. This sheet material is preferably a pliable material that can deform when impacted by an arrow such that the target portion stops the linear motion of the arrow without damaging the arrow. This pliable material can be a wide range of materials including a foam material including, but not limited to, a closed cell foam.

In one embodiment, sheet material is a single continuous sheet wrapped about a central core 22 such that it extends from core 22 to an outer perimeter surface 24. However, as can be appreciated, the target portion does not need to include the central core. Further, multiple sheets could be used. If included, the central core portion of the target also can be formed by a foam material similar to the layers extending about the core or can be formed by any material known in the art having material properties that will not damage an arrow when struck by the arrow.

Further, the outer surface 23 of core 22 can be cylindrical or the core can have a polygonal configuration or other configuration. In one embodiment, the core is cylindrical wherein the diameter of the central core can vary without detracting from the invention of this application. This can include cores from as small as around a ¼" to several inches depending on the desired physical characteristics of the archery target.

Figure 1A:
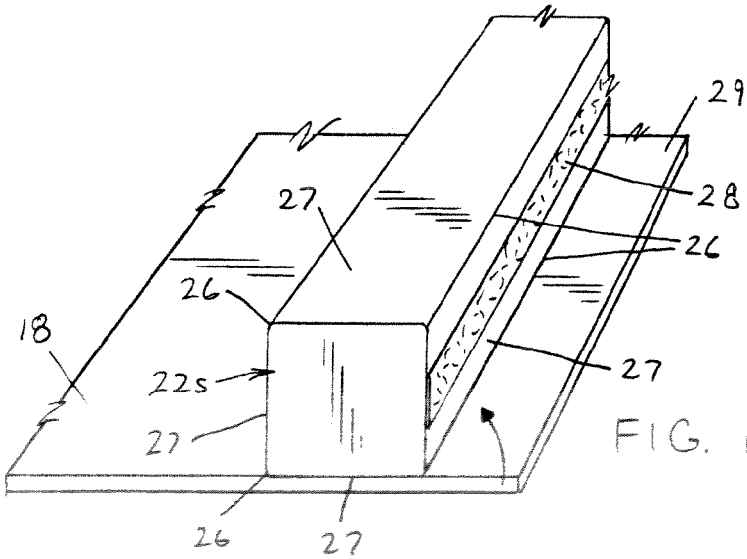
FIG. 1A is a perspective view of a square core of one embodiment of the target shown in FIG. 1.
Figure 2:
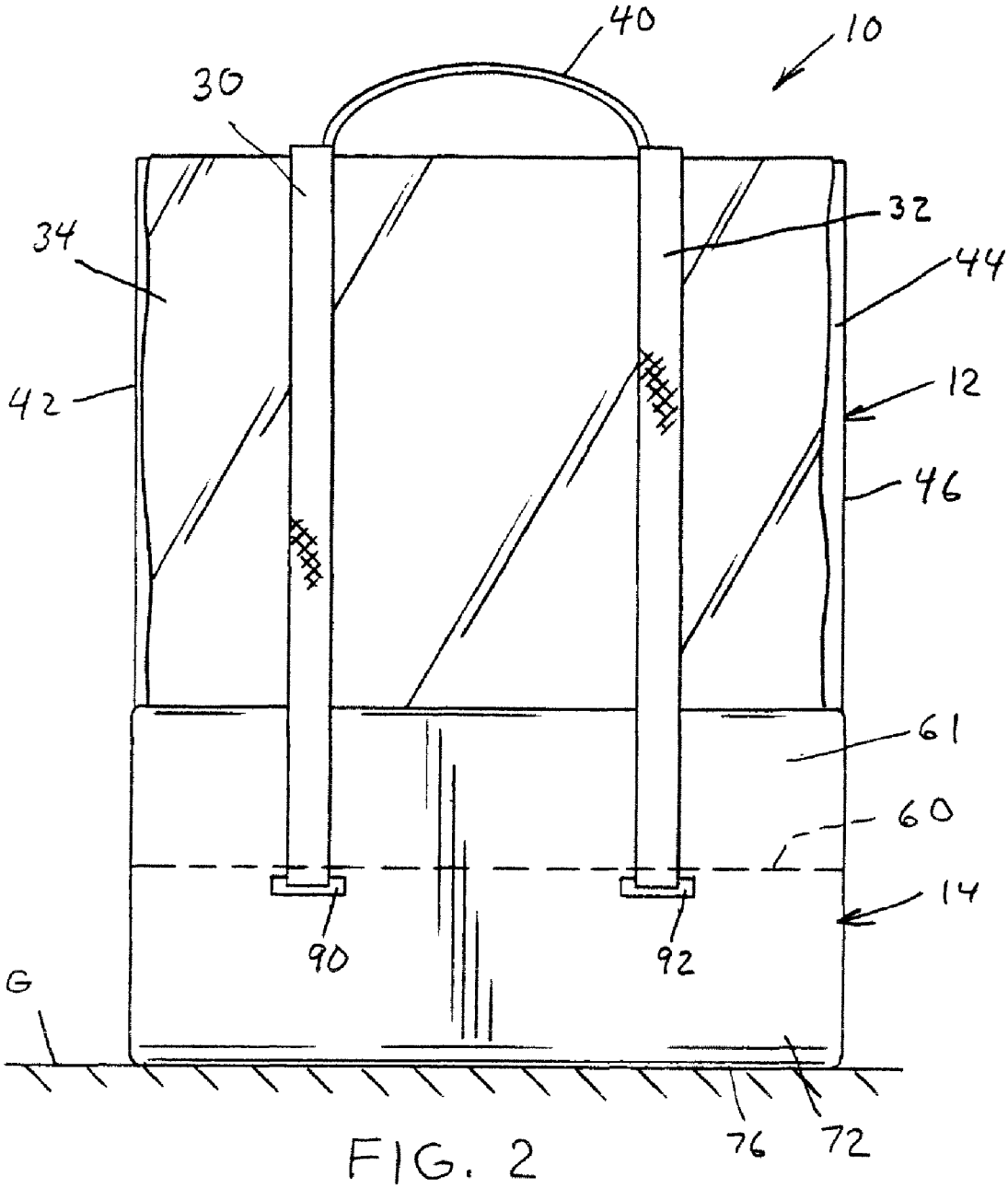
FIG. 2 is a side view of the target shown in FIG. 1.

In another embodiment, and with special reference to FIG. 1A, central core 22*s* can have a four sided cross-sectional configuration having corners 26 and flats 27 between the corners. It has been found that this configuration works exceptionally well to prevent what is referred to as coning which is the result of the core moving relative to one or more of the layers of sheet material 18. In one embodiment, core 22*s* is a square core having a cross-sectional configuration wherein flats 27 are between 0.25 inches and 4.0 inches wide. As can be appreciated, the length of this core is dictated by the size of the target. In another embodiment, the flats 27 are between 0.25 inches and 2.0 inches wide. In yet another embodiment, the flats 27 are between 0.25 inches and 1.0 inch wide. In a further embodiment, the flats are between 0.40 inches and 0.60 inches wide and in yet another embodiment, the flats are approximately 0.50 inches.

When sheet material 18 is wrapped about core 22, which will be discussed in greater detail below, an adhesive 28 can be used to secure end portion 29 of sheet material 18 to the core. This can also help prevent "coning." With respect to core 22S, adhesive 28 can be applied to a single flat 27 which is also the same single flap that end portion 29 engages as is shown in FIGS. 1 and 1A. Then, as the sheet material is tightly wrapped about core 22*s*, the core is compressed such that it generally forms a cylindrical core structure even though it has a square configuration before wrapping.

The central core also can be formed by a different colored material to form a central target portion or can be formed by a similarly colored material to essentially hide the core from the remaining portion of the target portion. Again, while the central core is shown to be cylindrical even after wrapping, the invention of this application should not be limited to a cylindrical central core.

In yet another embodiment, the central core can be a removable core or can at least include a portion that is removable.

As is stated above, the target portion is formed by a sheet material wrapped about central axis 20. The wrapping of this sheet material can be varied to produce different properties in the target portion. In this respect, the density of the target portion can be increased by wrapping the target portion with a higher tension such that the number of layers increases. It has been found that it is best to wrap the target portion under tension to increase the density of the wrapped layers. However, the amount of tension does not have to be great and can be varied based on a wide range of factors including the intended arrows, the environment for use and/or the shot distance.

The wrapped archery target can be maintained by a wide variety of structural elements. In one embodiment, straps 30, 32 can be used to maintain the wrapped target portion. However, while two straps are shown, more or less straps could be used without attracting from the invention of this application. Further, the strap can have a wide range of cross-sectional configurations.

In other embodiments, other structural arrangements can be used by themselves or in combination with other structural elements to maintain the rolled condition of sheet material 18. One of these includes an outer layer 34 that can be utilized to maintain the wrapped configuration of the target portion or merely utilized to create a printable surface for target indicia or insignia 35 that can be printed on cover 34 or even directly on a surface of sheets 18. This outer layer can partially or completely surround the target portion. In one embodiment, this outer layer is an outer plastic layer that completely surrounds the target portion and is separate from a stand 14 which is best shown if FIG. 4 and which is discussed in greater detail below in accordance with yet other embodiments of the invention of this application. Further, straps 30, 32 can be used in combination with outer layer 34 such that the straps maintain the wrapped condition of the sheets 18 while layer 34 is merely for visual purposes. As can be appreciated, layer 34 can be used to quickly customize target 10 based on customer requests.

In yet another embodiment, an adhesive can be used to maintain the wrapped condition or configuration of target portion 12. This embodiment can include the application of an adhesive to at least one side of sheet material 18 during the wrapping of the target portion such that each layer adheres to an adjacent layer to maintain the wrapped configuration. Or, in another embodiment, only select layers can include adhesive such as the first and the last layer wherein adhesive is used between sheet material 18 and core 22 and adhesive is also used on the last one or more convolutions of the sheet material.

Target 10 can further include a handle 40 that can be secured to any portion of target 10 including secured to the top of target portion 12 as is shown. In one embodiment, handle 40 is secured by straps 30 and 32.

After wrapping, sheet material 18 forms outer surfaces 42, 44 and 46 of target portion 12. However, as can be appreciated, these outer surfaces are formed by outer layer 34 when an outer layer is utilized even though they may be structurally based on the shape of sheet layers 18. Again, any one or any combination of, these surfaces can have any one of a number of insignia in an arrow receiving zone that can be in surface 42 or 46. These insignia can be any insignia known in the industry including, but not limited to, traditional target circles, deer configurations, multiple spaced targets incorporated thereon. Some of these insignia are shown in the prior art U.S. Pat. No. 7,222,860 which is incorporated by reference into the disclosure of this application. In yet another embodiment, outer layer 34 can be a removable outer layer such that it can be replaced when one or more of the insignia become overly damaged.

In yet another embodiment, target 10 can include stand 14 shaped to receive target portion 12. Further, straps 30 and 32 also can be attached to stand 14 to secure target portion 12 relative to stand 14 in addition to securing the position of sheet 18. Further, outer layer 34 can extend about target portion 12 to maintain the desired density of layers 18 wherein straps 30 and 32 can be used merely to secure the target portion relative to the base portion or layer 34 could also extend about the stand. While not shown, other combinations of securing devices and maintaining devices could be used without detracting from the invention of this application.

Stand 14 supports the target on a ground surface G which could be any type of underlying surface. Further, stand 14 can be sized to create the proper target height based on end use requirements. Stand 14 further includes target rest 60 which in one embodiment is an upwardly opened or facing curvilinear surface shaped to receive outer cylindrical surface 44 of target portion 12. As a result, gravity alone can maintain the target portion relative to the base portion without the need of fasteners or other securing devices. However, rest 60 could be any one of a wide range of configurations such as having a V-shaped configuration or having a U-shaped configuration or even can be formed by more than two planar surfaces even though these configurations are not shown herein.

In yet another embodiment of the invention of this application, rest 60 can be formed by upwardly extending members 61 and 62 shaped to engage target portion 12 to maintain the position of target portion 12 relative to stand 50. As discussed above, the members can include the curved surface or can form the curved surface. Further, as will be discussed more below, surface 60 does not need to be configured to be the exact same shape as outer surface 44 of target portion 12 wherein the entire surface does not need to engage the target portion.

Stand 14 also can have an axial length extending along axis 20 that is similar to the axial length of target portion 12. However, the matching of the lengths of stand 14 and target 12 is not required.

Stand 14 further includes a base 69 to support target 10 on the ground surface as is discussed above. Base 69 is configured such that the target is stable and can withstand the impact of an arrow without falling over. This support structure or base can include a number of configurations that create a stable and steady target and these configurations can include the use of compressible and non-compressible materials. In one embodiment, not shown, base 69 is a flat base. In another embodiment, base 69 includes legs 70 and 72 having bottom surfaces 74 and 76, respectively for engaging ground surface G. While these legs are shown to extend along the entire axial length of stand, this is not necessary for the target according to the present invention. However, this configuration could be utilized to reduce manufacturing costs such as allowing stand 14 to be extruded.

Stand 14 can be made from any known manufacturing technique in the art including, but not limited to, extruding, blow molding and injection molding. Stand 14 can further include one or more pockets, recesses, or compartments such as a compartment 80 configured to house any type of component and/or articles that could be used by an archer. As can be appreciated, this could include, but is not limited to, arrows, gloves and marking utensils.

As is discussed above, straps 30 and 32 can also extend about at least a portion of stand 14. In one embodiment, stand 14 includes openings 90 and 92 thereby allowing straps 30 and 32 to extend through a portion of stand 14. While not shown, the straps could extend about the bottom of the stand without detracting from the invention of this application. Further, outer layer 34 could also extend about stand 14 thereby securing target portion 12 to the stand.

Figure 3:
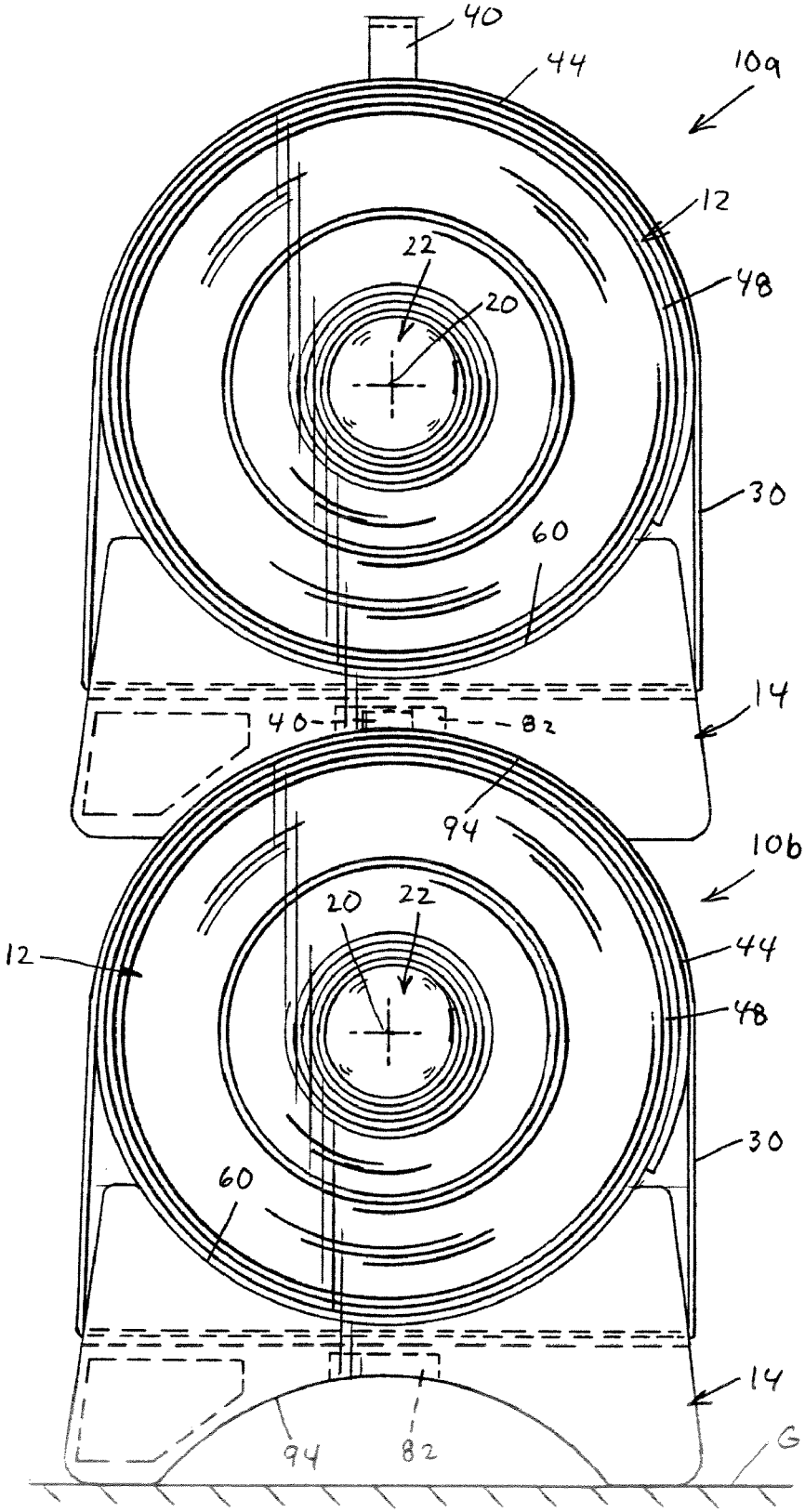
FIG. 3 is a front view of two targets wherein one target is stacked on top of another target.
Figure 4:
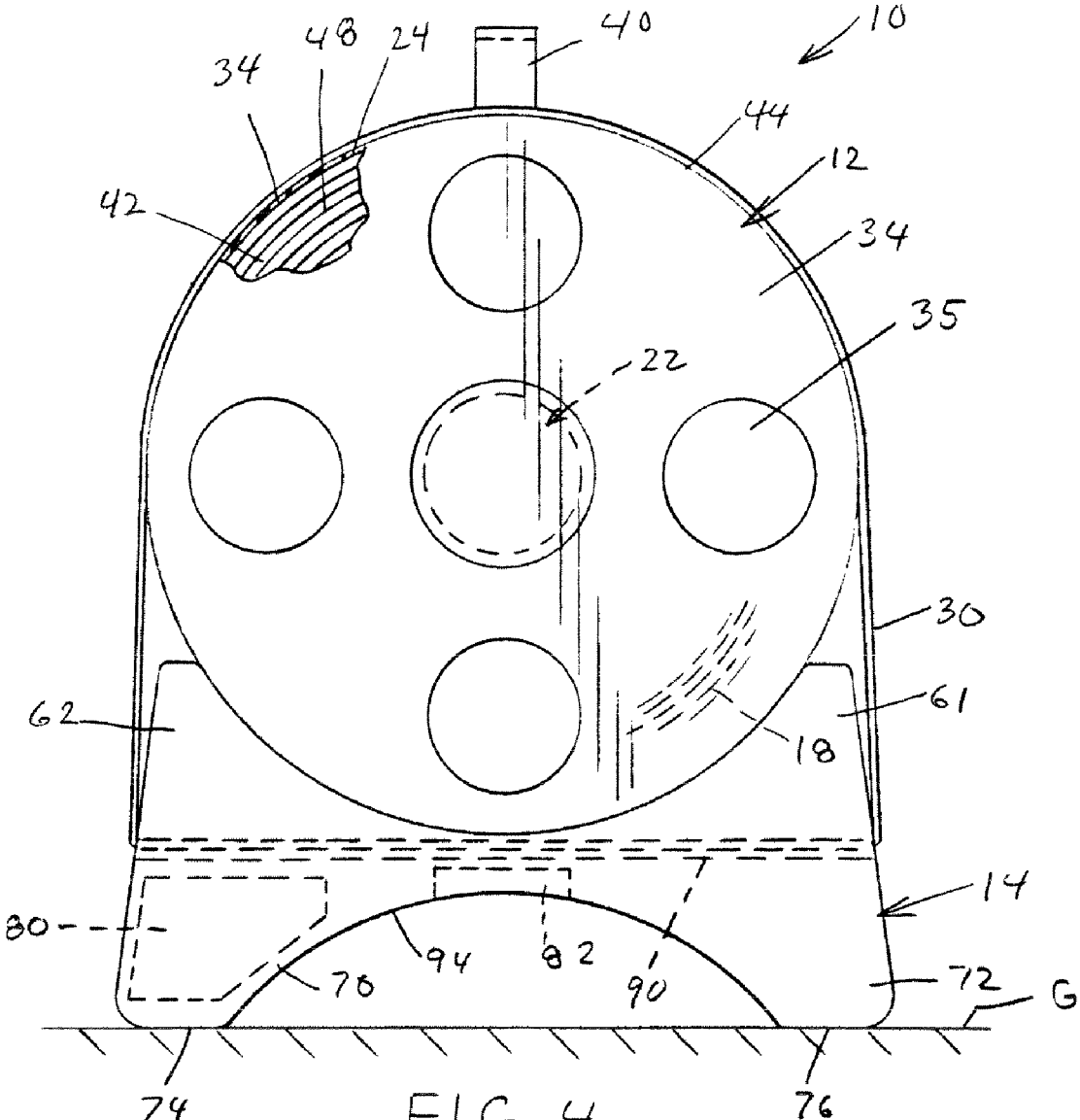
FIG. 4 is a front view of another embodiment of the target according to the invention of this application.

With reference to FIG. 3, shown are targets 10*a* and 10*b* wherein the targets can be configured to be stackable. In this respect stand 14 can include a downwardly facing or bottom stacking recess 94 that is shaped to matingly receive the top portion of another target 10. This configuration can be used to stack one target on another target for reducing shipping and/or storage costs and/or can be used by the end user to produce multiple targets. While not shown, a securing device could be utilized to secure target 10*a* to target 10*b*. As with rest 60, recess 94 can be a curvilinear surface shaped to receive outer cylindrical surface 44 of an adjacent target portion 12. However, as with rest 60, recess 94 could be any one of a wide range of configurations such as having a V-shaped configuration or having a U-shaped configuration or even can be formed by more than two planar surfaces.

In even yet another embodiment, stand 14 can further include a handle pocket or recess 82 configured to allow one target to sit on top of another target such that the handle of the other target is received by the pocket and the handle is not damaged during shipment. Further, this configuration can add to the stability of the top target, namely target 10*a* as is shown in FIG. 3.

In yet another embodiment, stand 14 can be used in connection with a cylindrical target that is not formed by layers 48. In this respect, other techniques known in the art could be used in connection with stand 14 wherein the improved stacking and transporting ability of the target can be utilized with other target configurations.

Figure 5:
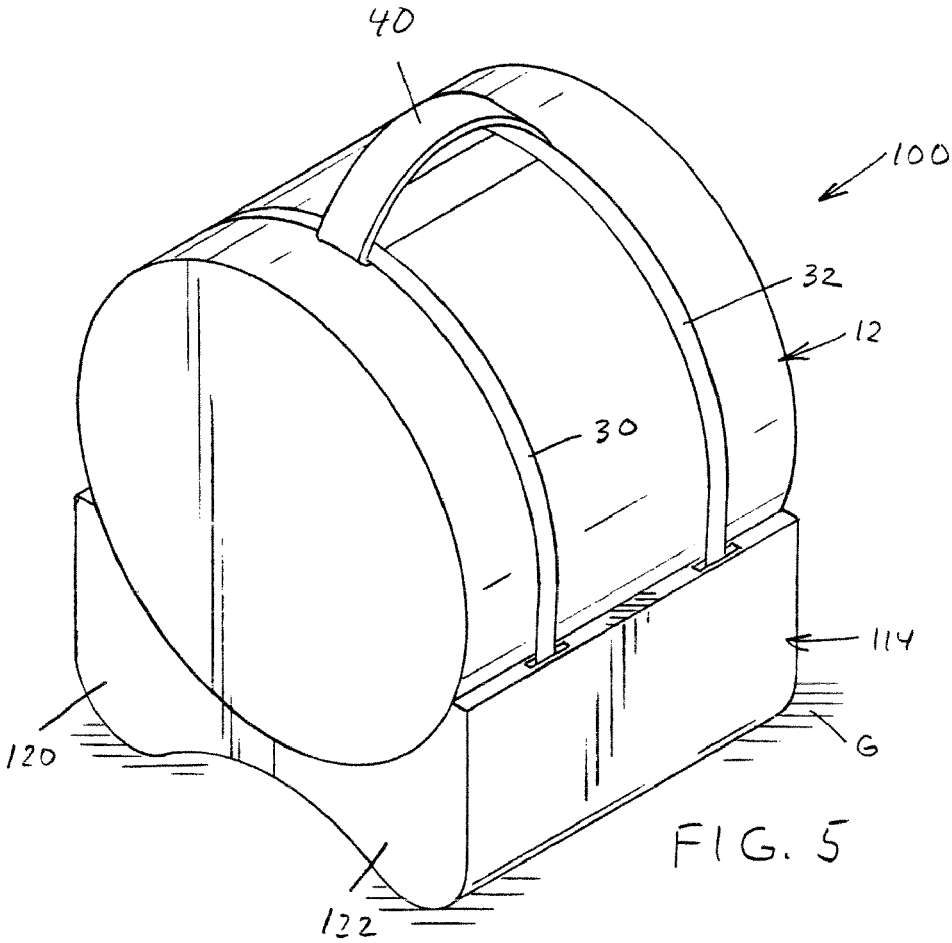
FIG. 5 is a front-side perspective view of yet another embodiment of the present invention including a two section stand.
Figure 6:
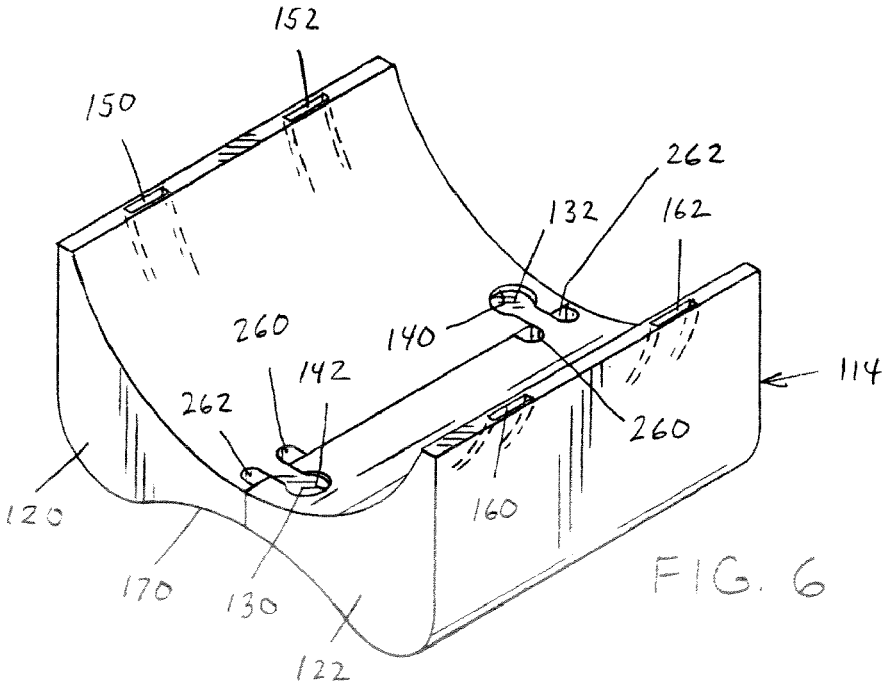
FIG. 6 is an enlarged front-side perspective view of the stand shown in FIG. 5.
Figure 7:
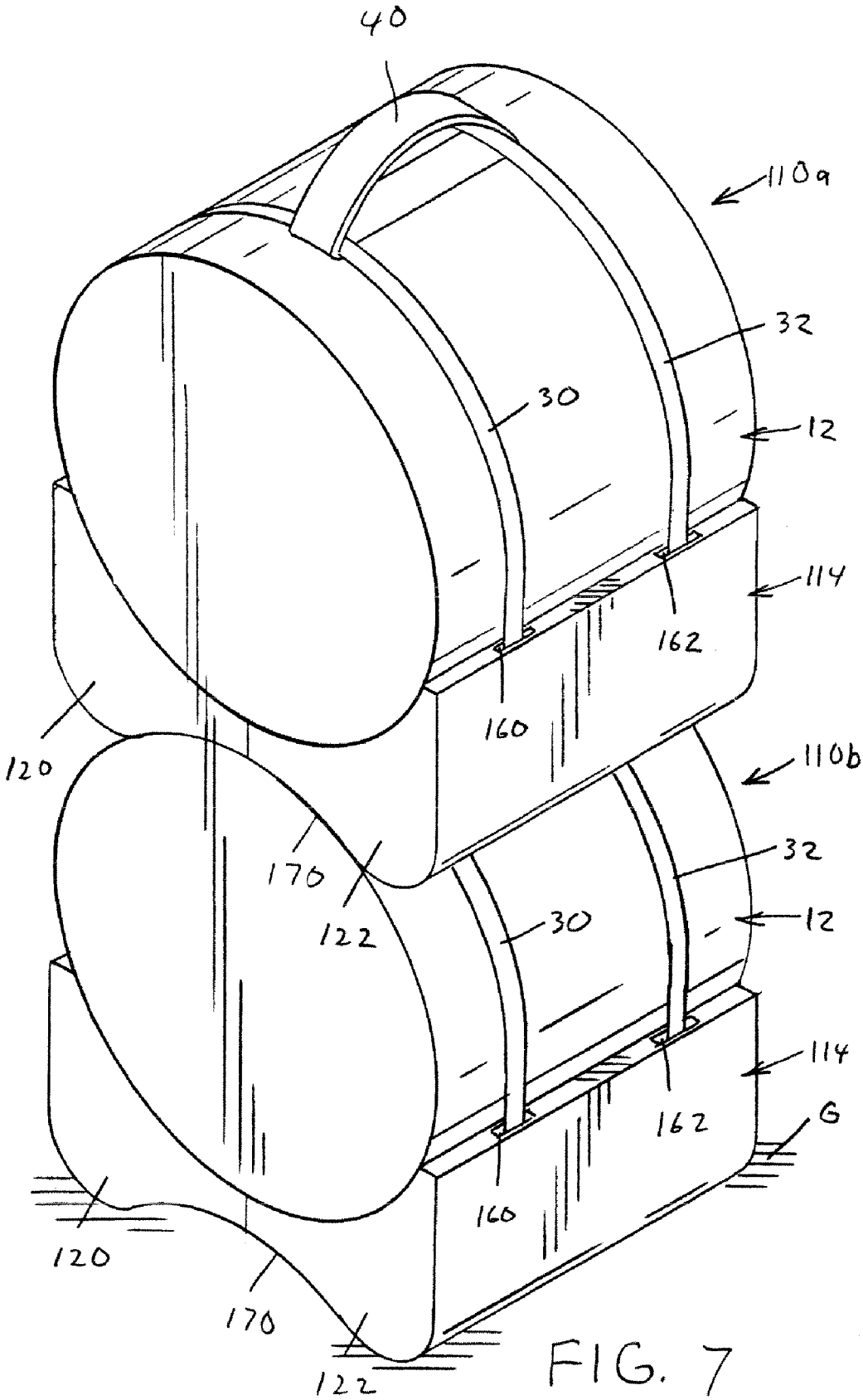
FIG. 7 is a front view of two targets, as is shown if FIG. 5, wherein one target is stacked on top of another target.
Figure 8:
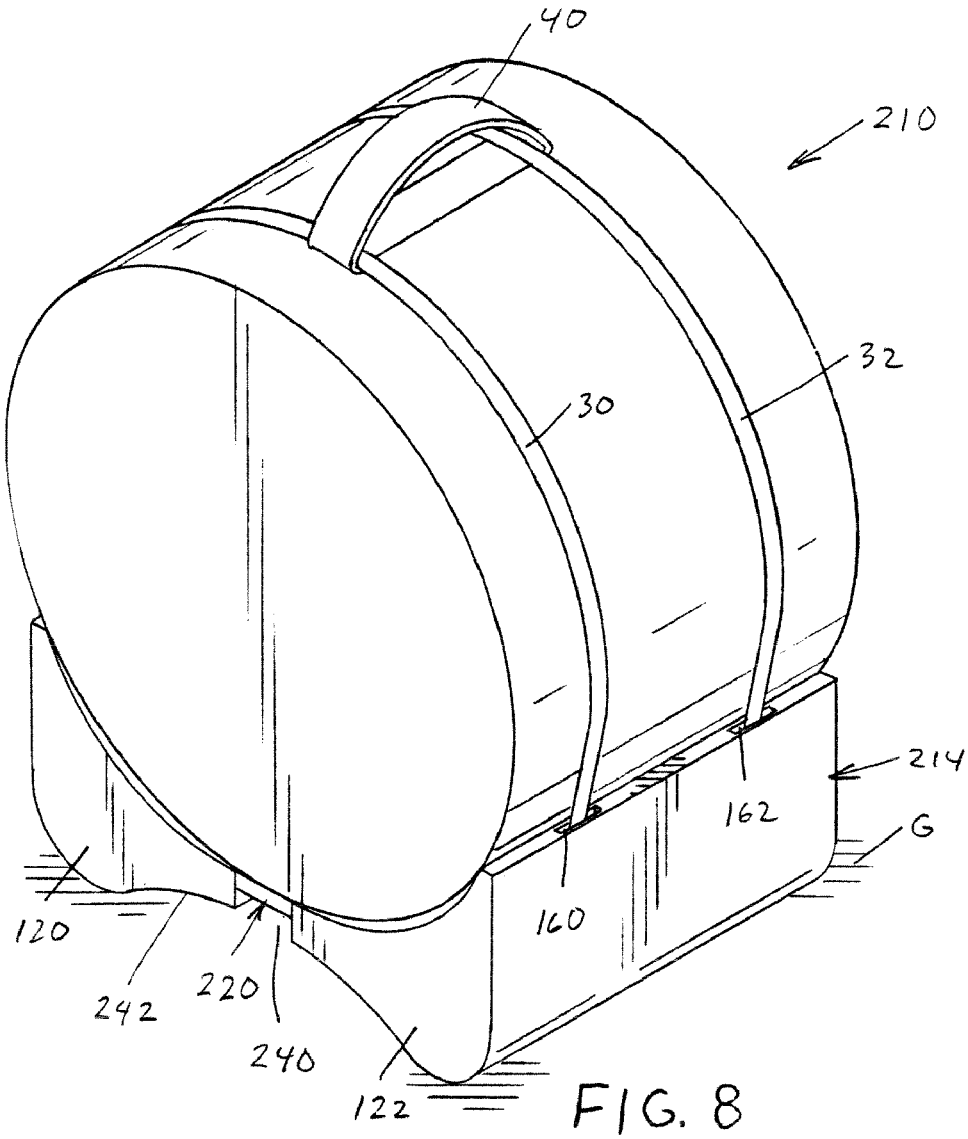
FIG. 8 is a front-side perspective view of a further embodiment of this application including a stand spacer.

With special reference to FIGS. 5-7, shown are yet other embodiments of the invention of this application. In this respect, shown is a target 100 that can include any or all of the features described above with respect to target 10 but, which also includes a universal stand structure 114 that can be used on a wide range of target sizes. More particularly, stand 114 includes a first stand section 120 and a second stand section 122. While not required, sections 120 and 122 can be configured the same such that a single section can be used for both sides. As can be appreciated, manufacturing costs can be reduced by having a single common component for both sections 120 and 122.

Section 120 includes a locking tab 130 and section 122 includes a locking tab 132. In addition, section 120 includes a lock receiver 140 and section 122 includes a lock receiver 142. Lock receiver 140 is shaped to lockingly receive locking tab 132 and lock receiver 142 is shaped to lockingly receive locking tab 130 such that section 120 can be locked to section 122. Again, sections 120 and 122 can be identical sections or at least substantially similar such that a single section design can be used for both. Once sections 120 and 122 are locked together, they form stand 114 which will support target 12 as is discussed in greater detail above.

Section 120 can further include openings 150 and 152 which are shaped to receive straps 30 and 32. Similarly, section 122 includes openings 160 and 162 shaped to receive straps 30 and 32. As a result, straps 30 and 32 can extend through both sections and at least partially hold these sections together. Further sections 120 and 122 can include any other feature as discussed above with respect to stand 14 including together forming a stacking recess 170. As a result, target 110*a* can be stacked on target 110*b* as is shown in FIG. 7.

In yet another embodiment, target 210 can include one or more spacers such as spacers 220 and 222 to enlarge the width of the stand and forms stand 214 shown in FIGS. 8-11. More particularly, stand 214 includes sections 120 and 122 with spacers 220 and 222 joining sections 120 and 122 such that stand 214 is wider than stand 114 even though the same stand sections are used for both. This configuration allow for additional manufacturing savings in that one stand section can also be used for multiple size targets. While only one size of spacer is shown, different sized spacers can be used to create a range of target sizes with a single base section configuration.

Figure 9:
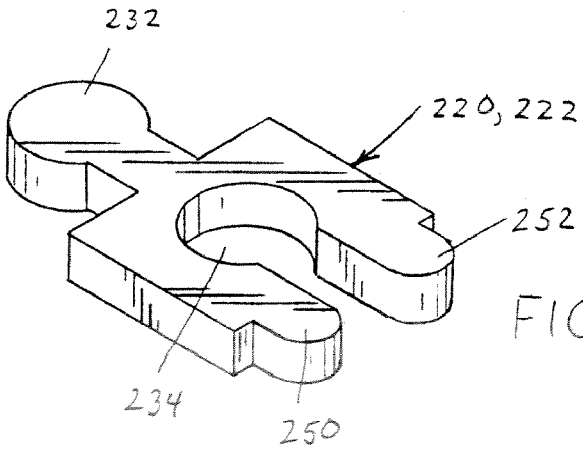
FIG. 9 is an enlarged front-side perspective view of the spacer shown in FIG. 8.
Figure 10:
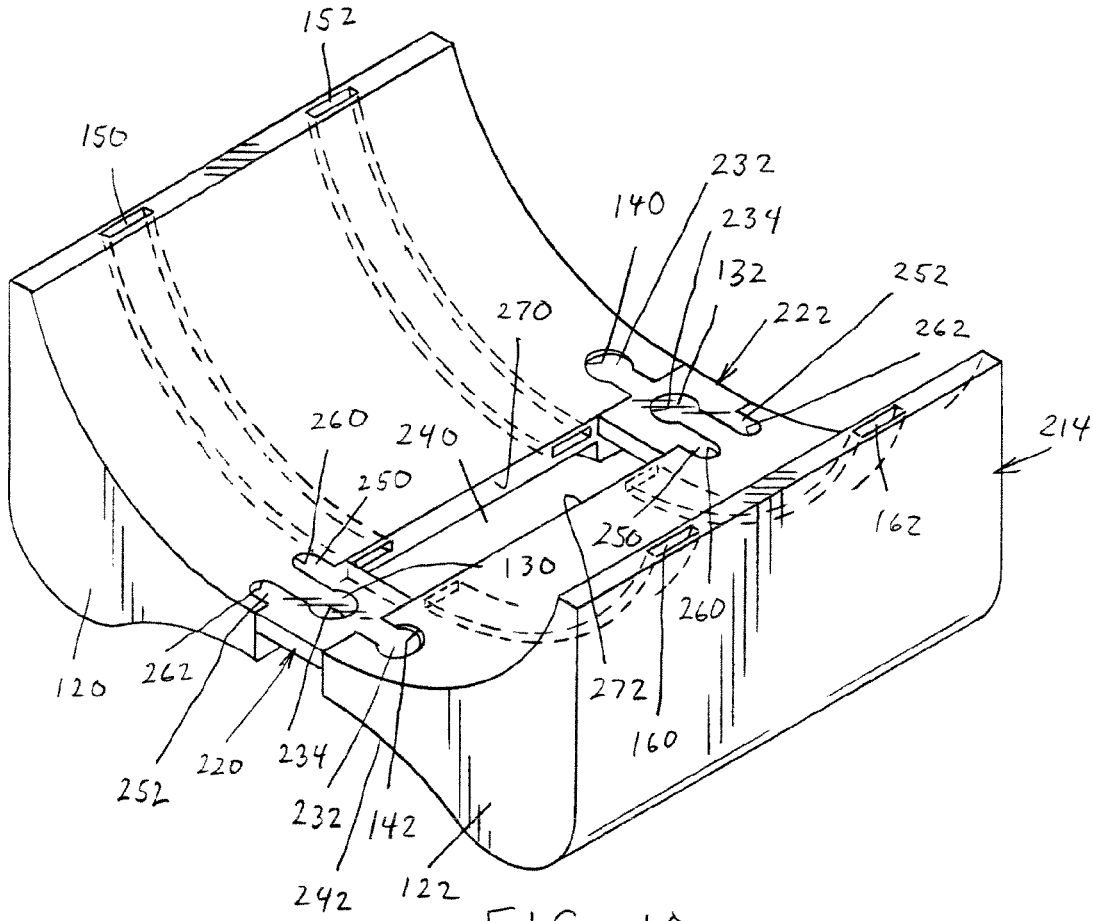
FIG. 10 is an enlarged front-side perspective view of the base shown in FIG. 8; and, FIG. 11 is a front view of two targets, as is shown if FIG. 8, wherein one target is stacked on top of another target.
Figure 11:
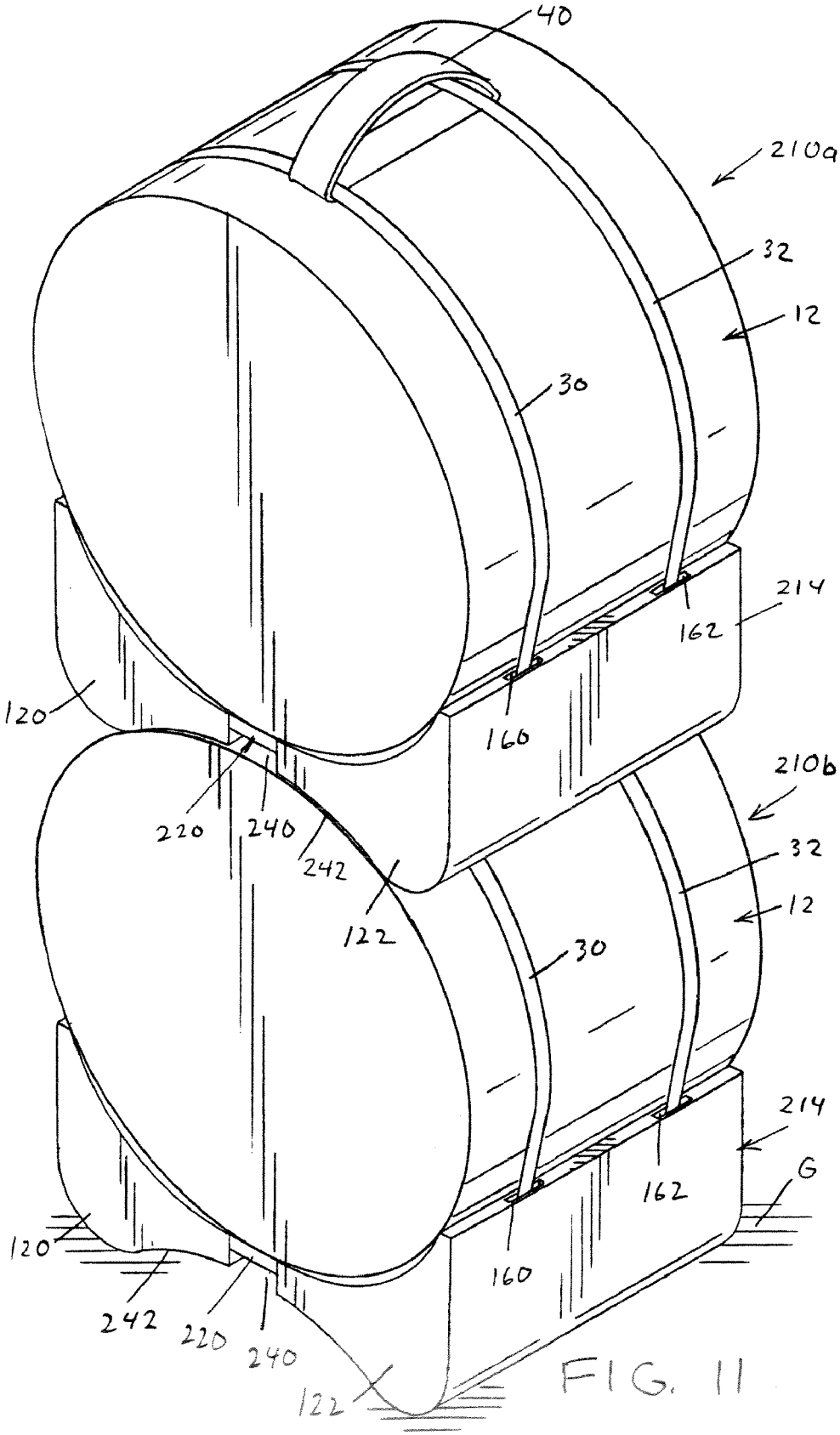

With special reference to FIG. 9, spacers 220 and 222 include a spacer locking tab 232 and a spacer lock receiver 234 such that lock receiver 234 is shaped to receive one of section tabs 130 and 132 of sections 120 and 122, respectively, and spacer tab 232 is shaped to engage one of section receivers 140 and 142 of sections 120 and 122, respectively. This configuration creates a gap or space 240 between sections 120 and 122 which increases the overall width of the stand. Again, sections 120, 122 and spacers 220 and 222 can include any other feature as discussed above with respect to stand 14 and/or 114 including together forming a stacking recess 242. As a result, target 210*a* can be stacked on target 210*b* as is shown in FIG. 11.

Spacers 220 and 222 can further include locking keys 250 and 252 configured to engage key pockets 260 and 262 in the sections on either side of the respective spacer tabs. With special reference to FIG. 10, spacers 220 and 220 are shown wherein spacer 220 extends between tab 130 of section 120 and receiver 142 of section 122; spacer 222 extends between tab 132 of section 122 and receiver 140 of section 120. Section 120 includes pockets 260 and 262 which receive keys 250 and 252, respectively, of spacer 220. Similarly, section 122 includes pockets 260 and 262 which receive keys 250 and 252, respectively, of spacer 222. These spacers create gap 240 between inner edges 270 and 272 of sections 120 and 122, respectively.

It has been found that a target according to the present invention can be made as follows. An adhesive is applied to the central core and the planar sheet material is adhered to a side of this central core. As is discussed in greater detail above, the central core can have a square cross-sectional configuration and the adhesive can be applied to one of the four sides of this elongated square core. Then, once the sheet is adhered to the one side of the square core, the sheet is tightly wrapped about the core to form a substantial portion of the target portion of the archery target.

As the sheet layer is tightly wrapped about the core, it deforms the core and the core forms a generally cylindrical shape. By using a square core and the adhesive connection, a significant property change takes place in this rolled target. In this respect, a target that is merely rolled about an axis has structural deficiencies which are realized once the target is used in the field. In this respect, the arrow impact and/or the removal of the arrow can cause what is referenced above as "coning." This is where the core, or another section of the target, move relative to other convolutions in the wrapped target portion. This creates a cone-like configuration where each convolution remains generally coaxial to each other but, one or more of the convolutions move axially relative to one another.

The sheet layer is wrapped until the desired target portion size is reached. As can be appreciated, this can vary based on the users target preferences. Once the desired size is achieved, the wrapped layers need to be secured in place to prevent both unwrapping and/or decompression of the compressible material used. In this respect, it has been found that closed cell foam works well to make the target of the invention of this application while it must be noted that other material could be used without detracting from the invention. This material is compressed during the wrapping process wherein this compression can be used to improve the overall properties of the target. The layers can be secured by straps that extend about the outer perimeter of these wrapped layers to hold them in place. Further, adhesives can be used to help secure the layers in place layer by layer or at specific layers such as the inner surface of the outer layer.

The target of this application can further include a stand to support the target and to prevent unwanted motion such as rolling motion from the cylindrical configuration of the target portion. This stand can be a two section stand such as a two common section stand that is configured to form half of the stand structure. The strap reference above can be either wrapped about the target portion only or also wrapped into the stand structure. Accordingly, once the target portion is wrapped, the strap or straps are positioned about the outer perimeter of the target portion and through the stand. Then, the straps are tightened to the desired tension to maintain the compression of the target portion and to securely attach the stand to the target portion. At this time, the target can be finalized which can include the addition of insignia or other markings. It can also include the addition of an outer layer if it is intended to extend about the target portion and/or stand. If the outer layer is only intended to be wrapped about the target portion, it can be positioned before the straps are put in place.

While considerable emphasis has been placed on the preferred embodiments of the invention illustrated and described herein, it will be appreciated that other embodiments and/or equivalents thereof can be made and that many changes can be made in the preferred embodiments without departing from the principles of the invention. Accordingly, it is to be distinctly understood that the foregoing descriptive matter is to be interpreted merely as illustrative of the invention and not as a limitation.

It is claimed:

1. An archery target configured to absorb an impact of an associated arrow, said target comprising a stand having a top side and a bottom side, said bottom side including a support structure for supporting said archery target on an associated surface, said top side including a target rest shaped to receive a portion of an outer perimeter of a cylindrical target portion in shaped engagement, said target portion having a front side and a back side which extend between said outer perimeter and define a target depth, at least one of said front and back sides includes an arrow receiving zone, said target portion further including a central core extending between said front and back sides and said core defining a target axis coaxial with said outer perimeter, said target portion further including at least one general planar sheet having side edges defining a sheet width that is generally equal to said target depth and a sheet surface between said side edges, said at least one sheet being wrapped about said core and said target axis and said side edges at least partially forming said arrow receiving zone, a portion of said sheet surface forming said outer perimeter, further including at least one strap extending about said outer perimeter, said strap maintaining said wrapped condition of said target portion, said stand further includes at least one opening for receiving said at least one strap, said at least one strap extending through said at least one opening and securing said target portion relative to said stand.

2. An archery target configured to absorb an impact of an associated arrow, said target comprising a stand having a top side and a bottom side, said bottom side including a support structure for supporting said archery target on an associated surface, said top side including a target rest shaped to receive a portion of an outer perimeter of a cylindrical target portion in shaped engagement, said target portion having a front side and a back side which extend between said outer perimeter and define a target depth, at least one of said front and back sides includes an arrow receiving zone, said target portion further including a central core extending between said front and back sides and said core defining a target axis coaxial with said outer perimeter, said target portion further including at least one general planar sheet having side edges defining a sheet width that is generally equal to said target depth and a sheet surface between said side edges, said at least one sheet being wrapped about said core and said target axis and said side edges at least partially forming said arrow receiving zone, a portion of said sheet surface forming said outer perimeter, said core is formed from a pliable material that has a rectangular cross-sectional configuration, said at least one sheet having an inner end and said inner end being affixed to one side of said rectangular core.

3. The archery target according to claim 2, wherein said inner end is adhesively affixed to one side of said rectangular core.

4. The archery target according to claim 3, wherein said core is formed from a pliable material having a square cross-sectional configuration.

5. The archery target according to claim 4, wherein said planar sheet is tightly wrapped about said square core such that said core is substantially formed into a cylindrical core.

6. The archery target according to claim 5, wherein each side of said square cross-sectional configuration is between 0.25 and 2.5 inches wide.

7. The archery target according to claim 5, wherein each side of said square cross-sectional configuration is approximately 0.5 inches wide.

8. The archery target according to claim 7, further including at least one strap extending about said outer perimeter, said strap maintaining said wrapped condition of said target portion, said stand further includes at least one opening for receiving said at least one strap, said at least one strap also extending through said at least one opening and securing said target portion relative to said stand.

9. An archery target configured to absorb an impact of an associated arrow, said target comprising a stand having a top side and a bottom side, said bottom side including a support structure for supporting said archery target on an associated surface, said top side including a target rest shaped to receive a portion of an outer perimeter of a cylindrical target portion in shaped engagement, said target portion having a front side and a back side which extend between said outer perimeter and define a target depth, at least one of said front and back sides includes an arrow receiving zone, said target portion further including a central core extending between said front and back sides and said core defining a target axis coaxial with said outer perimeter, said target portion further including at least one general planar sheet having side edges defining a sheet width that is generally equal to said target depth and a sheet surface between said side edges, said at least one sheet being wrapped about said core and said target axis and said side edges at least partially forming said arrow receiving zone, a portion of said sheet surface forming said outer perimeter, said archery target being a first archery target, said bottom side of said stand of said first archery target further includes a stacking recess shaped to receive an outer perimeter of a second said archery target such that said second archery target can be positioned on top of said first archery target.

10. An archery target configured to absorb an impact of an associated arrow, said target comprising a stand having a top side and a bottom side, said bottom side including a support structure for supporting said archery target on an associated surface, said top side including a target rest shaped to receive a portion of an outer perimeter of a cylindrical target portion in shaped engagement, said target portion having a front side and a back side which extend between said outer perimeter and define a target depth, at least one of said front and back sides includes an arrow receiving zone, said target portion further including a central core extending between said front and back sides and said core defining a target axis coaxial with said outer perimeter, said target portion further including at least one general planar sheet having side edges defining a sheet width that is generally equal to said target depth and a sheet surface between said side edges, said at least one sheet being wrapped about said core and said target axis and said side edges at least partially forming said arrow receiving zone, a portion of said sheet surface forming said outer perimeter, said stand includes a first section and a second section having the same general size and shape as said first section, said first and second edges having inner edges facing one another and including locking tab arrangements for selectively securing said first and second sections relative to one another.

11. The archery target according to claim 10, wherein said locking arrangement includes a locking tab extending from said inner edges and a locking recess adjacent said inner edges.

12. The archery target according to claim 10, wherein said first and second sections are configured substantially the same.

13. The archery target according to claim 12, wherein said locking arrangement includes a locking tab and a locking recess, said first and second sections both including a locking tab and a locking recess spaced from one another.

14. The archery target according to claim 10, wherein said stand further includes at least one spacer extending between said first and second sections and said locking tab arrangements including said at least on spacer, said at least one spacer forming a gap between said first and second sections.

15. The archery target according to claim 14, wherein said at least one spacer is two spacers and said locking arrangement includes a locking tab and a locking recess, said two spacers each having a locking tab and a locking recess.

16. The archery target according to claim 15, wherein said two spacers each include a key and said first and second sections each include a key pocket on either side of said receiver and said key being configured to interengage with said key pocket.

17. The archery target according to claim 15, wherein said at least one general planar sheet is a closed cell foam sheet.

18. An archery target configured to absorb an impact of an associated arrow, said target comprising a stand and a target portion, said target portion having a front and a back surface which include at least one shooting surface and a cylindrical outer perimeter extending about said front and back surfaces, said target portion further including a central core defining a central axis and extending between said surfaces and a wrapped layer formed by a single sheet of material extending from said core to said outer perimeter, said single sheet having side edges substantially forming said front and back surfaces, said stand including a first section and a second section wherein said first and second sections are substantially similar to one another and having inner edges that face one another, said sections together forming a target rest shaped to matingly receive a first portion of said outer perimeter, said archery target further including at least one strap extending about a second portion of said outer perimeter and interengaging with said sections thereby securing said sections relative to said target portion.

19. The archery target according to claim 18, wherein said inner edges are parallel to said axis.

20. The archery target according to claim 18, wherein said first and second sections each includes a locking tab arrangement for selectively securing said first and second sections relative to one another.

21. The archery target according to claim 20, wherein said locking arrangement includes a locking tab extending from said inner edges and a locking recess adjacent said inner edges.

22. The archery target according to claim 21, wherein said stand further includes at least one spacer extending between said first and second sections and said at least one spacer each including a locking tab and a locking recess.

23. The archery target according to claim 22, wherein said two spacers each include a key and said first and second sections each include a key pocket on either side of said receiver and said key being configured to interengage with said key pocket.

24. An archery target configured to absorb an impact of an associated arrow, said target comprising an elongated central core wherein said core is formed by a pliable material having a square cross-sectional configuration having a length and a width wherein said width is between 0.25 and 2.5 inches, said length extending in an axial direction and defining a central target axis, said square cross-sectional configuration of said core forming four general flat sides;

a planar sheet of pliable material extending between an inner end and an outer end, said sheet having side edges and a sheet surface extending between said inner and outer ends, said inner end being affixed to one of said four generally flat sides of said core such that said inner end is fixed relative to said core, said planar extending about said core in tightly wrapped convolutions wherein said outer end and a portion of said sheet surface form an outer perimeter of said archery target and said core is substantially formed into a cylindrical core, said side edges of said sheet forming a front and back surface of said target which include at least one shooting surface; and, at least one strap extending about at least a portion of said outer perimeter to maintain said tightly wrapped convolutions.

25. The archery target according to claim 24, wherein said inner end is adhesively affixed to said one of four flat sides.

* * * * *